United States Patent [19]

Boyle

[11] 4,407,417

[45] Oct. 4, 1983

[54] PRODUCT COUNTER DISPLAY

[75] Inventor: Daniel J. Boyle, Hartland, Wis.

[73] Assignee: Champion International Corporation, Stamford, Conn.

[21] Appl. No.: 219,248

[22] Filed: Dec. 22, 1980

[51] Int. Cl.[3] ..... A47F 7/00

[52] U.S. Cl. ..... 211/69.1; 211/69.9

[58] Field of Search ..... 211/69.1, 69.9, 72, 211/73; 248/174, 152, 459; 206/485, 443, 214

[56] References Cited

U.S. PATENT DOCUMENTS

| | | | |
|---|---|---|---|
| 1,887,145 | 11/1932 | Allendorf | 211/69.9 |
| 2,035,021 | 3/1936 | Pyle et al. | 211/73 X |
| 2,206,728 | 7/1940 | Nevins, Jr. | 211/73 |
| 2,285,214 | 6/1942 | Lisle | 211/69.9 |
| 2,315,617 | 4/1943 | Harrison | 248/174 |
| 2,506,461 | 5/1950 | Leach | 248/459 X |
| 2,806,608 | 9/1957 | Collura | 248/174 X |
| 2,911,106 | 11/1959 | McCormick | 211/69.1 |

FOREIGN PATENT DOCUMENTS

| | | | |
|---|---|---|---|
| 83099 | 4/1964 | France | 211/73 |

*Primary Examiner*—Ramon S. Britts
*Assistant Examiner*—Peter A. Aschenbrenner
*Attorney, Agent, or Firm*—Evelyn M. Sommer; William W. Jones; John H. Mulholland

[57] ABSTRACT

An improved counter display of the type having a back panel, a base support and a face panel for holding pencil-like objects, the improvement comprising means for hingedly coupling the base support to the lower end of both the face panel and the back panel, and means for hingedly attaching at least a portion of the face panel to an upper portion of the back panel in an overlapping relationship such that when the base support is pivoted about the coupling hinges to form a base, the face panel is hingedly moved perpendicularly away from the back panel to enable pencil-like objects to be mounted thereon.

2 Claims, 3 Drawing Figures

PRODUCT COUNTER DISPLAY

BACKGROUND OF THE PRESENT INVENTION

The present invention relates to cartons and in particular to a stand-up counter display for "pencil-like products".

Many products are on the market such as pens, mechanical pencils, eyebrow pencils, and the like which are "pencil-like" in shape and which need to have an attractive yet simple display which is economical to produce. Many pencil-like products are displayed simply in mass in an open box or carton. Others are mounted on attractive displays but these displays are complicated in design and expensive to manufacture, set up, and load up with the products.

The present invention relates to a product counter display for pencil-like objects which may be formed from a single blank, can be shipped in a flat state, is easily erected to receive the product and is easily loaded with the product. In its erected state, a base is formed and in the process of forming the base, the face panel which is to contain the product moves away from the back panel and thus makes loading easy and the display attractive. Further, a stand is integrally formed with the product whereby it may be used for a counter display or if desired, it may be hung on a rack or other sharp pointed object and displayed thereon.

Thus, the present carton is glued in such a way that when erected it creates a void for product insertion and consumer dispensing. The face, which holds the product, is formed with score lines that allow the face to move forward when the carton is erected to create the void.

The display also has an attached stand which not only functions to maintain the display in its upright position but also keeps the display in its open, erected state. Locking tabs are formed on the outer end of the stand for insertion in slots adjacent a base support in order to lock the carton in its stand-up state.

SUMMARY OF THE INVENTION

Thus the present invention relates to an improved counter display having a back panel, a base support and a face panel for holding pencil-like objects, the improvement comprising means for hingedly coupling said base support to the lower end of both face panel and said back panel and means for hingedly attaching at least a portion of said face panel to an upper portion of said back panel in an overlapping relationship such that when said base support is pivoted about said coupling hinges to form a base, said face panel is hingedly moved perpendicularly away from said back panel to enable pencil-like objects to be mounted thereon.

The invention also relates to a method of forming a display carton for pencil-like objects comprising the steps of forming a back panel and a base support hingedly attached thereto, forming a face panel having upper and lower glue panels hingedly attached thereto, said lower glue panel being narrower in width than said base support, said face panel having a center panel and upper and lower extension panels hingedly attached thereto, forming a plurality of aligned orifices in said upper and lower extension panels for receiving said pencil-like objects, integrally forming said narrower lower glue panel with said base support and attaching said lower glue panel to said base support in an overlapping relationship whereby said hinge line connecting said lower glue panel and said face is separated from said hinge line connecting said base support to said back panel, attaching said upper glue panel to the upper end of said back panel whereby said face panel is in a flat state against said back panel and pivoting said base support outwardly about said back panel hinge line and said lower glue panel hinge line thereby forcing said face panel outwardly in a perpendicular direction from said back panel to create a void for inserting and holding said pencil-like objects in said aligned orifice pairs.

The invention also relates to a blank for forming a stand up carton comprising a glue flap, a face panel including a central panel and hingedly connected upper and lower extension panels, said face panel being hingedly connected to said glue flap, orifices in said first and second extension panels in an aligned relationship for receiving pencil-like objects, a base support including an upper panel and a lower panel, said upper panel being integrally formed with and hingedly connected to said lower extension panel of said face panel, said upper panel being of less width than said lower panel, a back panel integrally formed with and hingedly attached to said lower panel of said base support by a score line, said score line having slots therein, a stand integrally formed with and hingedly attached to said back panel and a stand support panel integrally formed with and hingedly attached to said stand, said stand support panel having locking tabs thereon for insertion in said slots whereby said stand may be locked in its erected position to support said carton in its stand-up position.

BRIEF DESCRIPTION OF THE DRAWINGS

Other objectives and features of the present invention will be apparent in the following detailed description which should be taken in conjunction with the accompanying drawings in which like components are represented by like numerals and in which.

DETAILED DESCRIPTION OF THE DRAWINGS

Figure 1:
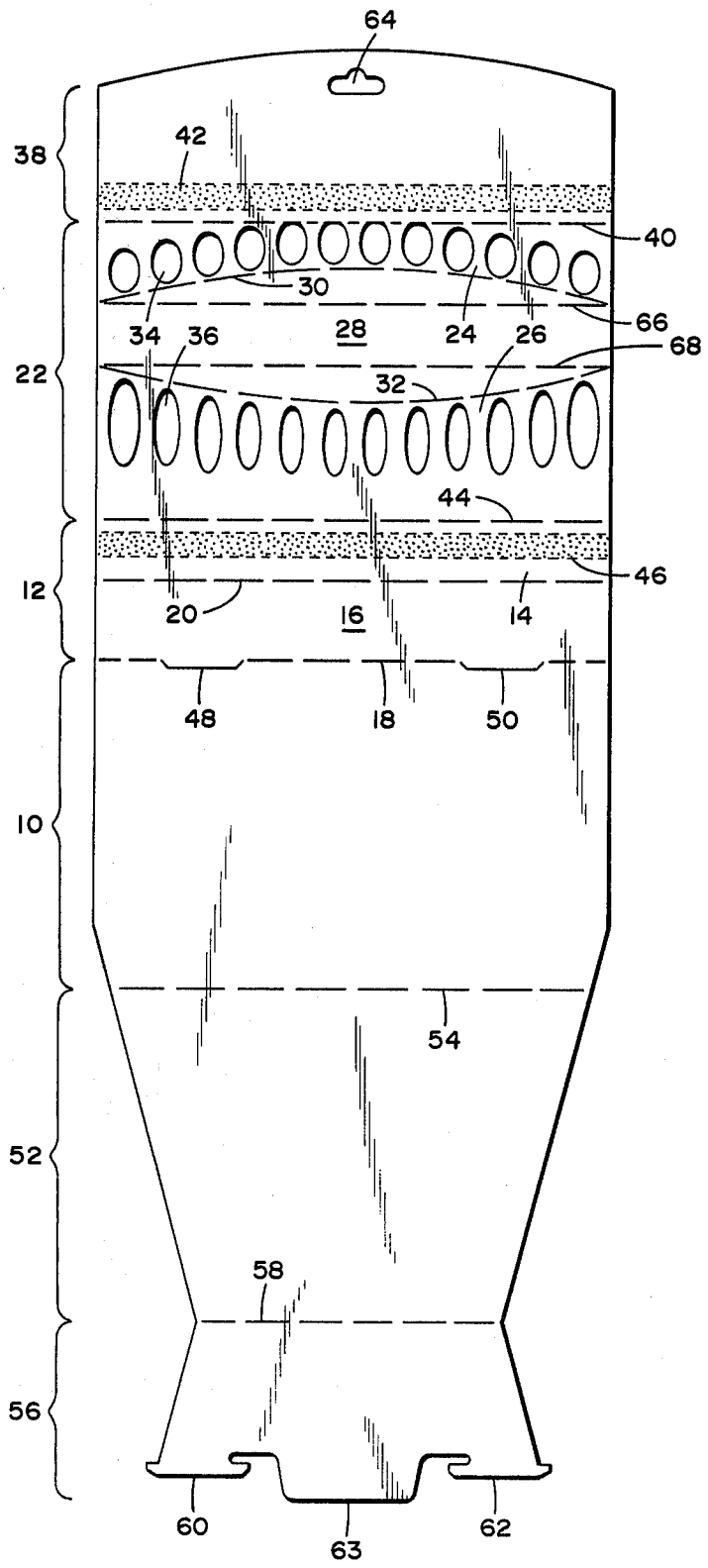
FIG. 1 is a plan view of a paper board blank from which the novel counter display may be constructed by proper folding and gluing.

FIG. 1 is a plan view of the one piece paper board blank from which the novel counter display carton of the present invention may be formed. The blank comprises a back panel 10 and a base support 12 having an upper panel 14 and a lower panel 16. The lower panel 16 is of greater width than the upper panel 14 and is also integrally formed with and hingedly attached to said back panel 10 by means of score line 18. Further, upper panel 14 of the base support 12 is integrally formed with and hingedly attached to lower panel 16 by means of score line 20. A face panel 22 includes top and bottom extension panels 24 and 26 respectively which are integrally formed with and hingedly attached on either side of center panel 28 by means of respective score lines 30 and 32. If desired, top panel 24 may be of smaller width than bottom panel 26. Each of the top and the bottom panels 24 and 26 have a plurality of corresponding aligned orifices 34 and 36 for receiving pencil-like objects. These orifices may be elliptical in shape and the orifices in lower panel 26 may have a larger major diameter than the orifices in upper panel 24. Thus, a pencil-like object may be inserted into orifice 34, pass under center panel 28, and exit through orifice 36 in bottom panel 26.

Top panel 24 is hingedly connected to glue panel 38 by means of score line 40. A glue strip 42 is located on the back side of glue panel 38 and is used to hingedly attach face panel 22 to back panel 10 as will be illustrated in relationship to FIGS. 2 and 3 hereafter. Bottom panel 26 is hingedly connected to base support 12 by means of score line 44. Upper panel 14 of base support 12 also has a glue strip 46 on the back side thereof which enables upper panel 14 to be glued lower to panel 16 in an overlapping relationship when upper panel 14 is folded over lower panel 16 to form the base support.

Slots 48 and 50 are formed in score line 18 between base support 12 and back panel 10 to receive locking tabs 60 and 62 as explained hereinafter.

Stand 52 is integrally formed with and hingedly attached to back panel 10 by means of score line 54. This stand is used to form an easel-like support to maintain the counter display carton in an erect state as will be shown hereinafter.

Finally, stand support panel 56 is integrally formed with and hingedly attached to stand 52 by means of score line 58. The stand support panel 56 includes locking tabs 60 and 62 which, when the display carton is completely folded and erected, are inserted into slots 48 and 50 on score line 18 to lock the display carton in its erected state. Extended tab 63 slides under lower panel 16 of base support 12 when the carton is locked in its erected state as shown in FIG. 3.

Instead of being utilized as a standup display the counter display may also be hung on any elongated device by means of orifice 64 in glue flap 38.

Figure 2:
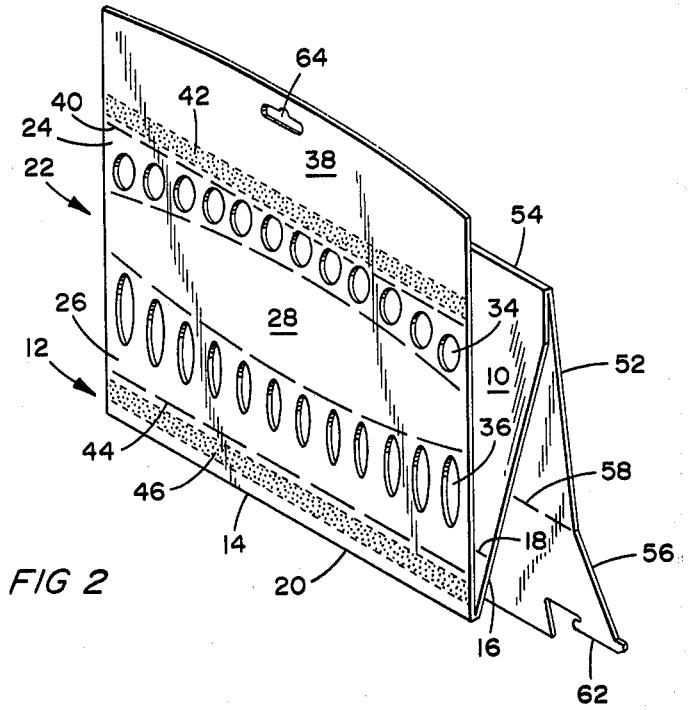
FIG. 2 is an isometric view of the blank of FIG. 1 in its partially folded condition illustrating the manner in which the folds are to be made.

FIG. 2 is an isometric view of the blank of FIG. 1 which has been partially folded and erected to illustrate how the counter display may be shipped in its flat state and also to illustrate the manner in which the blank must be folded and glued in order to form the stand-up counter display. It will be noted that the lower half of the blank is folded about score line 20 until back panel 10 has also been folded about score line 20 until upper panel 14 overlaps lower panel 16. By applying glue to glue strips 42 and 46, glue flap 38 may be rigidly attached to the upper portion of back panel 10 while upper panel 14 of base support 12 may be rigidly attached to lower panel 16 by means of glue strip 46. By also folding stand 52 and stand support panel 56 about score line 54, the unit may be shipped in its flat state to the supplier of the product.

Figure 3:
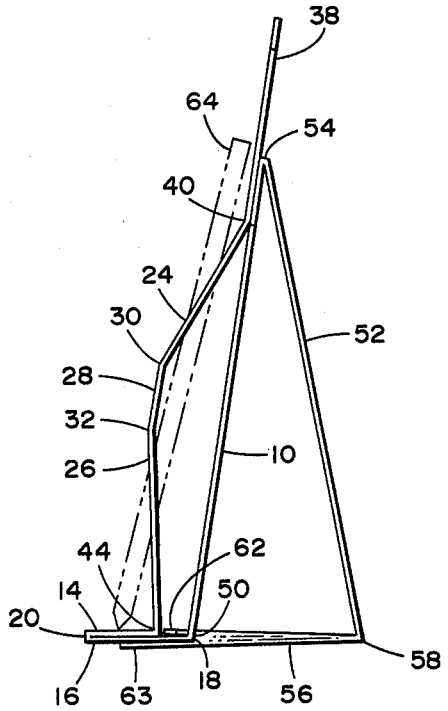
FIG. 3 is an end view of the fully assembled counter display carton illustrating the manner in which the blank of FIG. 1 is completely folded and properly assembled to receive the pencil-like objects for display purposes.

FIG. 3 is an end view of the novel counter display stand up carton in its completed state. In order to complete the folding and erection of the carton illustrated in FIG. 2 to obtain the carton as shown in FIG. 3, it is required to grasp the base support comprising upper panel 14 and lower panel 16 and pivot them upwardly about score lines 44 and 18. When this movement occurs, center panel 28 of face panel 22 is forced outwardly about score lines 30 and 32 because of base support upper panel 14 being of narrower width than lower panel 16. Because upper panel 14 of base support 12 has a narrower width than lower panel 16, the upward movement about score lines 44 and 18 causes face panel 22 to have the distance it occupies, with respect to back panel 10, shortened thus forcing it outwardly perpendicularly from back panel 10 about the appropriate score lines 30, 32, 40 and 44. This enables easy insertion of the pencil-like objects 64 to be inserted in a pair of orifices 34 and 36.

In order to maintain the display in this position, stand support panel 56 is folded about score line 58 and the locking tabs 60 and 62 are inserted in corresponding slots 48 and 50 in score line 18. Base extension panel 63 slides under lower panel 16 of the base support 12 to provide added stability. The resultant display is not only attractive but also is quickly erected, the product is easily loaded thereon and removed therefrom, the unit is easily shipped inasmuch as it can be shipped in its flat state and it is economically manufactured from an individual blank of paper board material.

It will be noted that in FIG. 1 while the center panel 28 of face panel 22 is formed with curved score lines 30 and 32, they may also be formed of straight score lines 66 and 68. Thus, the center panel 28 may have whatever form desired by the customer.

While the invention has been described in connection with a preferred embodiment, it is not intended to limit the scope of the invention to the particular form set forth. But, on the contrary, it is intended to cover such alternatives, modifications, and equivalents as may be included within the spirit and scope of the invention as defined by the appended claims.

I claim:

1. A product holder for displaying axially elongated products, such as pencils and the like, said holder comprising:

(a) a face panel comprising a center panel, a top extension panel foldably connected to a top edge of said center panel, and a bottom extension panel foldably connected to a bottom edge of said center panel, said top and bottom extension panels being provided with at least one pair of aligned apertures for receiving and displaying an elongated product;

(b) a base support comprising an upper base panel foldably connected to a bottom edge of said bottom extension panel along a first fold line, a lower base panel foldably connected to said upper base panel and adhesively secured to a lower surface of said upper base panel;

(c) a back panel foldably connected to said lower base panel along a second fold line which is offset from said first fold line;

(d) a glue panel foldably connected to a top edge of said top extension panel, said glue panel being adhesively secured to a top portion of said back panel;

(e) a stand panel foldably connected to a top edge of said back panel;

(f) a stand support panel foldably connected to a bottom edge of said stand panel;

(g) said first and second fold lines being operable, by reason of being offset from each other, to convert said holder from a flattened shipping condition to an expanded operable condition when said upper and lower base panels are pivoted from a first position substantially coplanar with said back panel to a second position substantially perpendicular to said back panel, said face panel being outwardly offset from said back panel when said holder is in said expanded operable condition; and (h) means for securing said stand support panel in a supporting position substantially coplanar with said base support when said holder is in said expanded operable condition.

2. The holder of claim 1, wherein said means for securing said stand support panel comprises at least one tab insertable in a cooperating slot formed in said second fold line.

* * * * *